US008302625B1

(12) United States Patent
Runkle et al.

(10) Patent No.: US 8,302,625 B1
(45) Date of Patent: Nov. 6, 2012

(54) VALIDATION OF WORKING FLUID PARAMETER INDICATOR SENSITIVITY IN SYSTEM WITH CENTRIFUGAL MACHINES

(75) Inventors: Mark Andrew Runkle, Schenectady, NY (US); Frederick William Block, Campobello, SC (US)

(73) Assignee: General Electric Company, Schenectady, NY (US)

( * ) Notice: Subject to any disclaimer, the term of this patent is extended or adjusted under 35 U.S.C. 154(b) by 39 days.

(21) Appl. No.: 13/167,231

(22) Filed: Jun. 23, 2011

(51) Int. Cl.
*G21C 17/00* (2006.01)

(52) U.S. Cl. ..... 137/565.33; 702/183

(58) Field of Classification Search ..... 137/565.33; 72/1.57; 702/50, 138, 182, 183
See application file for complete search history.

(56) References Cited

U.S. PATENT DOCUMENTS 3,657,926 A * 4/1972 Munson et al. ..... 702/138
6,532,433 B2 * 3/2003 Bharadwaj et al. ..... 702/182
7,200,524 B2 * 4/2007 Kang et al. ..... 702/183
7,266,986 B2 * 9/2007 Shirley et al. ..... 73/1.57
7,955,056 B2 * 6/2011 Pettersson ..... 702/182
2002/0161550 A1 * 10/2002 Bharadwaj et al. ..... 702/182
2004/0024568 A1 * 2/2004 Eryurek et al. ..... 702/182
2005/0165581 A1 * 7/2005 Roba et al. ..... 702/182
2005/0251364 A1 * 11/2005 Kang et al. ..... 702/183
2008/0027677 A1 * 1/2008 Miller et al. ..... 702/182
2011/0251825 A1 * 10/2011 Nagoshi ..... 702/183

OTHER PUBLICATIONS

Fournier, "You Asked: Functional Safety Clarified," Aug. 2009, p. 24, Canadian Process Equipment and Control News.

* cited by examiner

*Primary Examiner* — John Rivell
(74) *Attorney, Agent, or Firm* — Hoffman Warnick LLC; Ernest G. Cusick

(57) ABSTRACT

Disclosed herein is an approach that validates the sensitivity of a working fluid parameter indicator in a system using centrifugal machines. In one aspect, a lead centrifugal machine and a lag centrifugal machine supply a working fluid to a distribution conduit. A working fluid parameter indicator measures a process parameter associated with the working fluid supplied to the distribution conduit by the lead centrifugal machine and the lag centrifugal machine. A controller validates the sensitivity of the working fluid parameter indicator to measure the process parameter associated with the working fluid as a function of operation of the lag centrifugal machine relative to the lead centrifugal machine during an operational test performed on the centrifugal machines.

20 Claims, 4 Drawing Sheets

400

VALIDATION OF WORKING FLUID PARAMETER INDICATOR SENSITIVITY IN SYSTEM WITH CENTRIFUGAL MACHINES

BACKGROUND OF THE INVENTION

The present invention relates generally to systems utilizing centrifugal machines to perform a process operation, and more particularly to determining whether a process instrument used in conjunction with the centrifugal machines is operating properly during normal operation.

Typical process instruments (e.g., sensors, transducers, regulators, meters, etc.) used in conjunction with centrifugal machines (e.g., pumps, compressor, fans, etc.) do not have the ability to convey their health status, i.e., their ability to perform their intended function. Some modern smart process instruments have the ability to convey their health status to a control device via the use of Highway Addressable Remote Transfer (HART) protocol signals or through similar means. Because some of these smart process instruments can be unreliable when used in conjunction with centrifugal machines, any information regarding their health status that is conveyed to a control device from the instruments can be inaccurate. As a result, plant operators may not know that there is a problem with the process instrument until much time has elapsed since it actually started to lose its ability to perform its intended function. Trying to resolve faulty operating process instruments after much time has elapsed usually results in unwanted costs associated with fixing the process instruments such as shutting down the plant in which the process instrument operates.

BRIEF DESCRIPTION OF THE INVENTION

In one aspect of the present invention, a system is provided. The system comprises a distribution conduit and at least two centrifugal machines configured to supply a working fluid to the distribution conduit. One of the at least two centrifugal machines comprises a lead centrifugal machine and a second of the at least two centrifugal machines comprises a lag centrifugal machine. A working fluid parameter indicator measures a process parameter associated with the working fluid supplied to the distribution conduit by the at least two centrifugal machines. A controller validates the sensitivity of the working fluid parameter indicator to measure the process parameter associated with the working fluid. The controller validates the sensitivity of the working fluid parameter indicator as a function of operation of the lag centrifugal machine relative to the lead centrifugal machine during an operational test of the centrifugal machines.

In another aspect of the present invention, a system is disclosed. The system comprises a distribution conduit and at least two redundant centrifugal machines configured to supply a working fluid to the distribution conduit. One of the at least two redundant centrifugal machines comprises a lead centrifugal machine and a second of the at least two redundant centrifugal machines comprises a lag centrifugal machine. A flow splitter conduit splits the flow of the working fluid from the at least two redundant centrifugal machines to the distribution conduit into different flow paths. One or more working fluid parameter indicators measures a process parameter associated with the working fluid as supplied from the flow splitter conduit to the distribution conduit. A working fluid regulator located between the flow splitter conduit and the distribution conduit regulates the flow of the working fluid therebetween according to the process parameter measured by the one or more working fluid parameter indicators. A controller validates the operational health of at least one of the working fluid parameter indicators and the working fluid regulator based on an operational test performed on the lead centrifugal machine and the lag centrifugal machine.

DETAILED DESCRIPTION OF THE INVENTION

Figure 1:
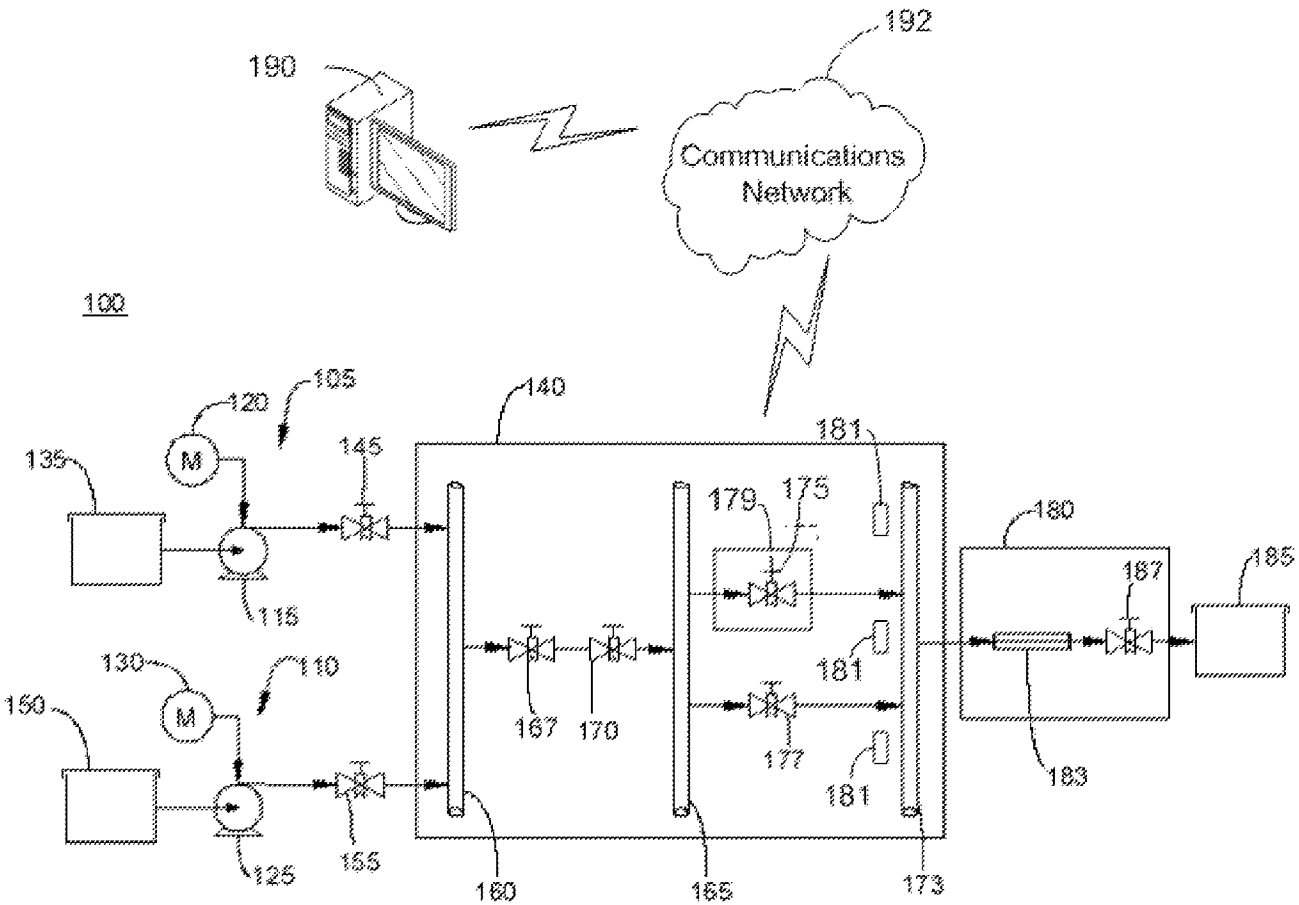
FIG. 1 is a diagram illustrating a process operation in which embodiments of the present invention may be implemented.

Various embodiments of the present invention are directed to performing an operational test on centrifugal machines used in a system in order to obtain a diagnostic on a process instrument used in the system. Embodiments of the present invention are suited for use with centrifugal machines that share a load of supplying working fluid to a distribution conduit. In one embodiment, the centrifugal machines may comprise a lead centrifugal machine and a lag centrifugal machine. A working fluid parameter indicator may be located about the distribution conduit to measure a process parameter associated with the working fluid supplied to the distribution conduit by the centrifugal machines. Other process instruments may be used in addition to the working fluid parameter indicator such as a working fluid regulator that can regulate the flow of the working fluid and working fluid flow meters that measure the flow of the fluid. In one embodiment, the operational test may include turning on the lag centrifugal machine while the lead centrifugal machine is already on which causes it to contribute in sharing the load of supplying the working fluid to the distribution conduit, and turning off the lag centrifugal machine after operating in conjunction with the lead centrifugal machine for a predetermined period of time in order to transfer the load back to the lead centrifugal machine. In one embodiment, a controller can validate the sensitivity of the working fluid parameter indicator and other process instruments (e.g., working fluid regulator) used in the system by comparing process parameter measurements to a baseline of previously obtained process parameter measurements. In one embodiment, the controller can compare an operational test signature formed from the process parameter measurements against a baseline operational test signature. In either embodiment, the controller can validate the sensitivity of the working fluid parameter indicator and/or other process instruments used in the system if the measurements are within an acceptable range of deviation to the baseline of measurements.

Technical effects of the various embodiments of the present invention include improving monitoring the operational health of process instruments used in a system that employs centrifugal machines. This enables plant operators to learn sooner about faulty process instruments and those that are developing incipient problems. As a result, corrective actions can be taken at an earlier point in time, resulting in better reliability and availability of a process operation. Furthermore, validating the operability of instruments on-line may extend the maintenance interval for those devices and save process owners considerable expense. Another technical effect of the various embodiments of the present invention is that the concepts disclosed here are applicable to partial proof testing in standards such as International Electrotechnical Commission [IEC] 61511 for Safety Instrumented Systems and the USA parallel in ISA 584.01.

FIG. 1 is a schematic diagram illustrating an example of a process operation 100 utilizing redundant motor-driven centrifugal machines 105 and 110 in which embodiments of the present invention may be implemented. In this example, redundant motor-driven centrifugal machines 105 and 110 operate in parallel to move a working fluid in a steam lube oil tank. Although the various embodiments of the present invention are described with respect to the use of redundant motor-driven centrifugal machines to supply a working fluid such as hydraulic fluid to a steam lube oil tank, those skilled in the art will recognize that the embodiments described herein are suitable for use in any process operation in which centrifugal machines can be used to supply a working fluid. As used herein, a working fluid can include liquids such as water, lubricating oil, liquid fuel, and gases such as air, natural gas, ammonia and other typical substances in power or chemical processes. Other non-limiting examples in which motor-driven centrifugal machines are utilized and that are suitable for use with the various embodiments described herein include centrifugal fans used in ventilation systems (e.g., safety critical ventilation systems), centrifugal pumps used as fuel-forwarding pumps for fuel oil in gas turbine fuel systems, water delivery systems, and centrifugal compressors used in air liquefaction processes.

Referring back to FIG. 1, in this embodiment, centrifugal machine 105 is a lead centrifugal machine because it is the primary mover of the working fluid (e.g., hydraulic fluid), while centrifugal machine 110 is the lag centrifugal machine because it can serves as a backup mover of the fluid when the lead centrifugal machine is not operating properly, or because it can share in the load of supplying fluid with the lead centrifugal machine. Those skilled in the art will recognize that commercial and industrial systems commonly provide at least one prime mover for functions deemed critical to a process and perhaps more than one lag prime mover. However, for ease of illustrating an application of the embodiments of the present invention, only one lead centrifugal machine and one lag centrifugal machine are illustrated in FIG. 1. As shown in FIG. 1, lead centrifugal machine 105 comprises a pump 115 driven by a motor 120, while lag centrifugal machine 110 comprises a pump 125 driven by a motor 130. In one embodiment, motors 120 and 130 are industrial motors that can take the form of induction motors. In this example, lead centrifugal machine 105 and lag centrifugal machine 110 are configured to move hydraulic fluid (e.g., lubrication oil). As shown in FIG. 1, lead centrifugal machine 105 moves the hydraulic fluid from a container 135 to a steam lube oil tank 140 via a valve 145. Lag centrifugal machine 110 is configured to move the hydraulic fluid from a container 150 to steam lube oil tank 140 via a valve 155. The hydraulic fluid supplied by lead centrifugal machine 105 and lag centrifugal machine 110 is fed into steam lube oil tank 140 via a common supply conduit such as a manifold header 160. Common supply conduit 160 is coupled to a flow splitter conduit 165 that functions as an intermediate manifold header in steam lube oil tank 140, via valves 167 and 170. In one embodiment, valve 167 can represent a heat exchanger that cools the hydraulic fluid and valve 170 can act as filter that removes undesirable particulates, oil sludge and varnish from the oil before it is supplied to the turbine bearings. In one embodiment, flow splitter conduit 165 splits the flow of the hydraulic fluid into different flow paths.

A distribution conduit 173 that functions as an outlet manifold header in steam lube oil tank 140 recombines the fluid that is split into different flow paths by in flow splitter conduit 165. As shown in FIG. 1, one flow path directs hydraulic fluid into distribution conduit 173 via valve 175 and another flow path directs fluid into the conduit via a valve 177. In one embodiment, valve 175 can represent a fluid regulator 179 that regulates the flow of the hydraulic fluid according to a process parameter such as pressure. Note that the control components of fluid regulator 179 are not illustrated in FIG. 1. In one embodiment, valve 177 represents an orifice valve that restricts the flow of the fluid. With this configuration, the flow of the hydraulic fluid from flow splitter conduit 165 to distribution conduit 173 can be designed to supply the fluid so that one path supplies more, less or equal amounts of fluid as the other flow path. For example, flow splitter conduit 165 can split the flow of the working fluid through the flow paths to have a two-to-one flow, so that 60% of the flow is directed towards valve 177 and 40% of the flow is directed towards fluid regulator 179. Those skilled in the art will recognize that the representation of the fluid regulator and the orifice valve are only examples of what possible process instruments can be used at these locations. Note that for a constant hydraulic impedance load, regulating pressure is equivalent to regulating flow. For a flow critical application, instead of a fluid regulator and an orifice valve in parallel to control pressure, a flow meter in series with an automatic control valve that regulates to directly control flow can be used to provide a measure of the hydraulic fluid from flow splitter conduit 165 to distribution conduit 173. In another embodiment, it is possible that valve 175 operates as a flow valve that provides some control in how the fluid is directed from flow splitter conduit 165 to distribution conduit 173 and not as a fluid regulator.

As shown in FIG. 1, at least one working fluid parameter indicator 181 is located about distribution conduit 173. Each working fluid parameter indicator 181 measures a process parameter associated with the working fluid supplied to distribution conduit 173 by centrifugal machines 105 and 110. In this embodiment of FIG. 1, working fluid parameter indicator 181 is a pressure sensor and the measured process parameter is the pressure of the hydraulic fluid. In this embodiment, the pressure sensor can be used to ensure that adequate pressure is supplied to flow conduit 173. In embodiments where centrifugal machines 105 and 110 are being used to supply hydraulic fluid to bearings in the drive trains of a turbine, it is important to maintain the flow while the turbine is running in order to avoid the excessive costs associated with a shut-down to service the turbine.

Those skilled in the art will recognize that other process parameter indicators that can measure pressure of the hydraulic fluid can be used in FIG. 1 such as pressure transducers, pressure transmitters, pressure senders, etc. For sake of simplicity in illustrating the general concept of the embodiments of the present invention, only three working fluid parameter indicators are shown. Those skilled in the art will recognize that there may be a wide range of indicators in use, ranging from one to many more.

Furthermore, for other alternative applications in which the embodiments of the present invention have utility (e.g., ventilation systems using centrifugal fans, fuel-forwarding pumps using fuel-forwarding pumps, air liquefaction processes using centrifugal compressors, etc.), other working fluid parameter indicators relevant to the particular application can be used in place of the pressure sensors shown in FIG. 1. For example, for a ventilation system used as a safety critical ventilation system, working fluid parameter indicators can be gas detectors that detect the amount of gas (e.g., methane) being moved by the centrifugal fans.

Referring back to FIG. 1, distribution conduit 173 supplies the hydraulic fluid from steam lube oil tank 140 to lubricate a bearings unit 180 which in one embodiment can be used in drive trains associated with a turbine. In particular, a conduit 183 within bearings unit 180 receives the hydraulic fluid from steam lube oil tank 140 and provides it to the various bearing orifices. The hydraulic fluid is then sent to a tank 185 via a valve 187. Those skilled in the art will appreciate that containers 135 and 150 and tank 185 may all be the same vessel.

A controller 190, shown in FIG. 1 as a computer, is used to control process operation 100 via a communications network 192. Although not illustrated in FIG. 1, those skilled in the art would recognize that controller 190 is configured to communicate with lead centrifugal machine 105 and lag centrifugal machine 110, which includes the motor/pump sets of lead motor 120 and pump 115, and lag motor 130 and pump 125. In addition, controller 190 is configured to communicate with steam lube oil tank 140 and tank 185 and each of their respective process instruments (e.g., working fluid parameter indicators 181 and valves 167, 170, 175, 177 and 187).

In one embodiment, controller 190 is configured to validate the sensitivity of working fluid parameter indicator 181 and/or any other process instruments that are used in process operation 100. As used herein, validating the sensitivity of the working fluid parameter entails confirming the operability of the instrument to perform its intended function within a process operation (e.g., to measure a particular process parameter associated with the working fluid). In one embodiment, controller 190 validates the sensitivity of working fluid parameter indicator 181 as a function of operation of lag centrifugal machine 110 relative to lead centrifugal machine 105 during an operational test of the centrifugal machines.

In one embodiment, the operational test includes turning on lag centrifugal machine 110 while lead centrifugal machine 105 is on, so that it contributes in sharing the load of supplying the hydraulic fluid to distribution conduit 173. The test further includes turning off lag centrifugal machine 110 after operating in conjunction with lead centrifugal machine 105 for a predetermined period of time in order to transfer the load back to the lead centrifugal machine. In one embodiment, controller 190 receives a plurality of process parameter measurements, such as for example, pressure measurements, from working fluid parameter indicator 181 during the operational test. In one embodiment, controller 190 can obtain the pressure measurements from working fluid parameter indicator 181 by any one of a number of well-known data acquisition techniques using currently available electronic communications systems such as Modbus, Prophibus, CanBus, Foundation Field Bus, High Speed Ethernet, etc.

Controller 190 can compare the pressure measurements to a baseline of previously obtained pressure measurements. The baseline of previously obtained pressure measurements can be acquired after installation of centrifugal machines 105 and 110 in process operation 100 or after a refurbishment of the machines. Controller 190 validates the sensitivity of working fluid parameter indicator 181 in response to determining that the pressure measurements obtained during the operational test are within an acceptable range of deviation to the baseline of previously obtained process parameter measurements. As used in one embodiment, an acceptable range of deviation to the baseline of previously obtained process parameter measurements may be within about 5% of previous values. Those skilled in the art will appreciate that this range of deviation is only an example of one acceptable range of deviation and is not meant to limit the scope of the various embodiments of the present invention. For example, those skilled in the art will appreciate that the more critical the process, the greater the need for a statistical process control approach to the data to establish upper and lower specification limits for specifying an acceptable range of deviation.

In another embodiment, controller 190 can form an operational test signature from the pressure measurements. In this embodiment, the operational test signature is characterized by a peak portion indicative of when lag centrifugal machine 110 turned on, a trough portion indicative of when the lag centrifugal machine turned off, a middle portion between the peak portion and the trough portion that is indicative of a stable state in which lead centrifugal machine 105 and the lag centrifugal machine share the load. In one embodiment, controller 190 can utilize a trender that trends data collected from a process. An example of a device that can trend data for use by controller 190 is a motor protection system which can be utilized in motor driven processes. Typically, motor protection systems (e.g., motor relays, meters, motor control centers, etc.) are used to protect motors from failing, but many of these systems are configured to acquire data and perform various functions including trending of data. A 369 Motor Management Relay sold by GE Multilin is one example of a commercially available motor protection device that can be used to perform the trending function while an operation test is performed on centrifugal machines 105 and 110.

In the embodiment utilizing data signatures, controller 190 can compare the operational test signature to a baseline operational test signature having a baseline peak portion indicative of a turn-on event for lag centrifugal machine 110, a baseline trough portion indicative of a turn-off event for the lag centrifugal machine, a baseline middle portion between the baseline peak portion and the baseline trough portion that is indicative of a stable operational running event in which lead centrifugal machine 105 and the lag centrifugal machine share the load. The baseline operational test signature can also be acquired after installation of centrifugal machines 105 and 110 in process operation 100 or after a refurbishment of the machines. Controller 190 validates the sensitivity of working fluid parameter indicator 181 in response to determining that the peak portion, middle portion and trough portion of the operational test signature are within an acceptable range of deviation to the baseline peak portion, the baseline middle portion and the baseline trough portion of the baseline operational test signature. As used in one embodiment, an acceptable range of deviation to the baseline of previously obtained process parameter measurements may be within about 5% of previous values. Those skilled in the art will appreciate that this range of deviation is only an example one acceptable range of deviation and is not meant to limit the scope of the various embodiments of the present invention. For example, those skilled in the art will appreciate that the more critical the process, the greater the need for a statistical process control approach to the data to establish upper and lower specification limits for specifying an acceptable range of deviation. The validation of the sensitivity of working fluid parameter indicator 181 as described above is further explained below with reference to FIGS. 2 and 3A-3C.

After performing the operational test, controller 190 can generate a process status notification (e.g., an alarm) to a plant operator or the like that indicates how well the working fluid parameter indicator 181 or any other process instrument in process operation 100 is working. Those skilled in the art will appreciate that various notifications can be made to the plant operator through one of many different mediums used for reporting information. For example, notification can comprise an alarm, an electronic mail, or a report that provides the measurements, deviation from the baseline data, various details of the events that have occurred during the process operation and possible causes for notifications containing poor operability results and a list of potential corrective actions. These are only a non-exhaustive listing of possible forms of notification that may be used, however, embodiments of the present invention are not limited to any particular form of notification.

In addition to validating the sensitivity of working fluid parameter indicator 181 and/or any other process instruments that are used in process operation 100, controller 190 can perform a variety of other functions. For example, controller 190 can be used to control lead centrifugal machine 105 and lag centrifugal machine 110 and their respective components (i.e., the motor/pump sets of lead motor 120 and pump 115, and lag motor 130 and pump 125). Other functions may include performing remote monitoring and diagnostics of centrifugal machine 105 and lag centrifugal machine 110, as well as general management of these assets and other assets (e.g., pumps, valves, manifolds, etc.) utilized in process operation 100.

Although not explicitly shown in FIG. 1, another computer may be located locally about centrifugal machine 105 and lag centrifugal machine 110, so that a plant operator or engineer can have closer interaction with the systems at the process level of process operation. Regardless of where computers are located in the process operation, these computers can be implemented with the various embodiments of the present invention to facilitate validating the sensitivity of various process components (e.g., working fluid parameter indicator 181, fluid regulator 179, etc.) used in process operation 100.

In various embodiments of the present invention, portions of the control actions performed by controller 190 can be implemented in the form of an entirely hardware embodiment, an entirely software embodiment or an embodiment containing both hardware and software elements. In one embodiment, the processing functions performed by controller 190 may be implemented in software, which includes but is not limited to firmware, resident software, microcode, etc.

Furthermore, the processing functions performed by controller 190 can take the form of a computer program product accessible from a computer-usable or computer-readable medium providing program code for use by or in connection with a computer or any instruction execution system (e.g., processing units). For the purposes of this description, a computer-usable or computer readable medium can be any computer readable storage medium that can contain or store the program for use by or in connection with the computer or instruction execution system.

The computer readable medium can be an electronic, magnetic, optical, electromagnetic, infrared, or semiconductor system (or apparatus or device). Examples of a computer-readable medium include a semiconductor or solid state memory, a random access memory (RAM), a read-only memory (ROM), a rigid magnetic disk and an optical disk. Current examples of optical disks include a compact disk-read only memory (CD-ROM), a compact disk-read/write (CD-R/W) and a digital video disc (DVD)

Figure 2:
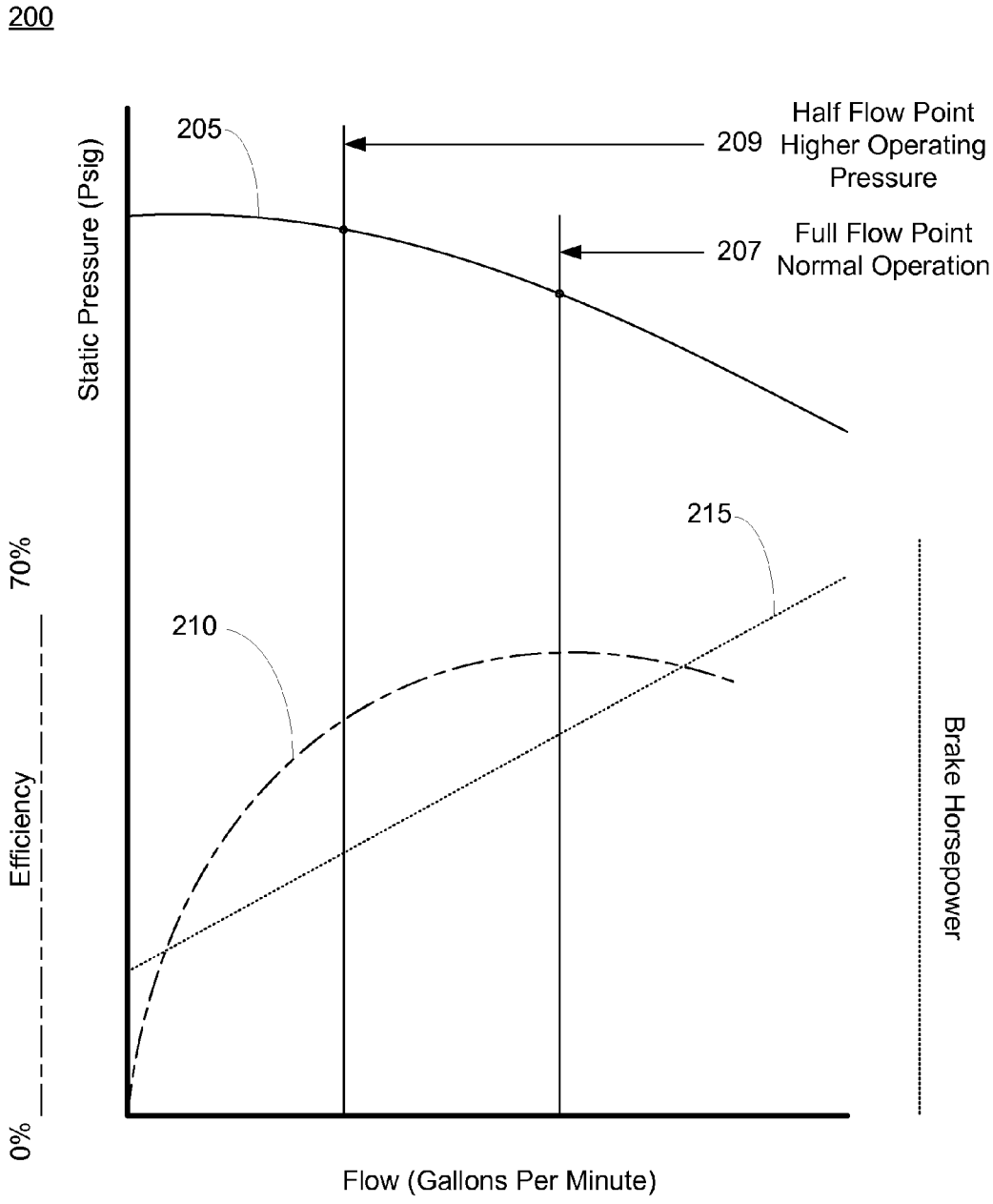
FIG. 2 is a pump graph of a typical centrifugal pump that may operate in the process operation of FIG. 1.

The validation of the sensitivity of working fluid parameter indicator 181 as described above is now explained with reference to FIGS. 2 and 3A-3C. FIG. 2 shows a pump graph 200 for a typical centrifugal pump used in a steam lubrication system. As shown in FIG. 2, graph 200 includes a pressure/flow regulation curve 205 for a centrifugal pump. Pressure/flow regulation curve 205 shows a point 207 where the centrifugal pump is operating normally at a full-flow point and at a half-flow point 209. As shown in FIG. 2, the pressure increases to a higher operating pressure point on curve 205 as the flow is decreased from full flow operating set point 207 to half flow operating set point 209. Another way to describe the relationship shown in pressure/flow regulation curve 205 is that the pressure decreases with increasing flow. Graph 200 also shows an efficiency curve 210 for a typical centrifugal pump used in a steam lubrication system. As shown in FIG. 2, the efficiency of the centrifugal pump decreases on efficiency curve 210 as the flow is decreased from full flow operating set 207 point to half flow operating set point 209. Another way to describe the relationship shown in efficiency curve 210 is that the efficiency increases with increasing flow. Graph 200 also shows a brake horsepower curve 215 for a typical centrifugal pump used in a steam lubrication system. As shown in FIG. 2, the brake horsepower decreases linearly on curve 215 as the flow is decreased from full flow operating set point 207 to half flow operating set point 209. Another way to describe the relationship shown in curve 215 is that the brake horsepower increases linearly with increasing flow.

Using the relationships illustrated in FIG. 2, graphs can be derived to illustrate the operation of redundant centrifugal machines such as centrifugal pumps that operate in a parallel implementation during the running of the aforementioned operational test. Similarly, graphs can be derived to illustrate the operation of working fluid parameter indicator 181 and/or any other process instruments that are used in process operation 100 such as fluid regulator 179, flow meters, etc. The data embodied by these graphs provides a baseline as either raw data or a signature that controller 190 can use to compare to measurements taken from working fluid parameter indicator 181 during a test operation. Examples of these graphs are set forth in FIGS. 3A-3C.

Figure 3A:
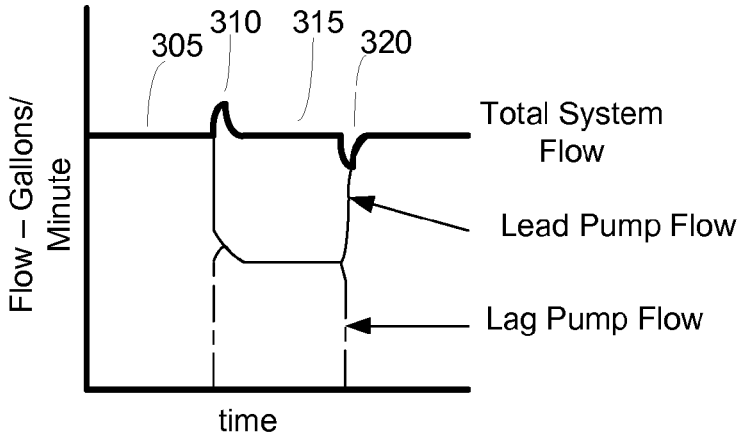
FIGS. 3A-3C are graphs illustrating operation of the centrifugal machines depicted in FIG. 1 during an operational test performed on the machines according to one embodiment of the present invention.

FIG. 3A illustrates the total flow of the hydraulic fluid during the operational test of centrifugal machines 105 and 110 (e.g., centrifugal pumps), as well as the flow of each individual machine. At region 305, lead centrifugal machine 105 is supplying the hydraulic fluid. Region 310 indicates an abrupt spike or a peak portion in the flow. The spike in the total flow occurs at this point because lag centrifugal machine 110 is turned on to contribute in the load of supplying fluid to tank 185. FIG. 3A shows that the flow of lead centrifugal machine 105 decreases while the flow of lag centrifugal machine 110 increases at this point. Because there is an increase in flow in hydraulic fluid, fluid regulator 179 will notice a rise in pressure, and as a result cause the flow to decrease to stabilize the pressure. Region 315 shows the period of time in which the flow provided by both lead centrifugal machine 105 and lag centrifugal machine 110 have stabilized to equilibrium after fluid regulator 179 took action. As shown in FIG. 3A, during this stabilized period of flow, lead centrifugal machine 105 and lag centrifugal machine 110 are essentially supplying the same amount of hydraulic fluid. At region 320, lag centrifugal machine 110 is shut off during this portion of the operational test. Region 320 indicates a trough portion in which the flow decreases abruptly. The trough portion in the total flow occurs at this point because lag centrifugal machine 110 is turned off and no longer contributes in the load of supplying fluid to tank 185. At this point, FIG. 3A shows that the flow of lead centrifugal machine 105 increases while the flow of lag centrifugal 110 machine decreases. Because there is a decrease in flow in hydraulic fluid, fluid regulator 179 will notice a decrease in pressure, and as a result cause the flow to increase to stabilize the pressure.

Figure 3B:
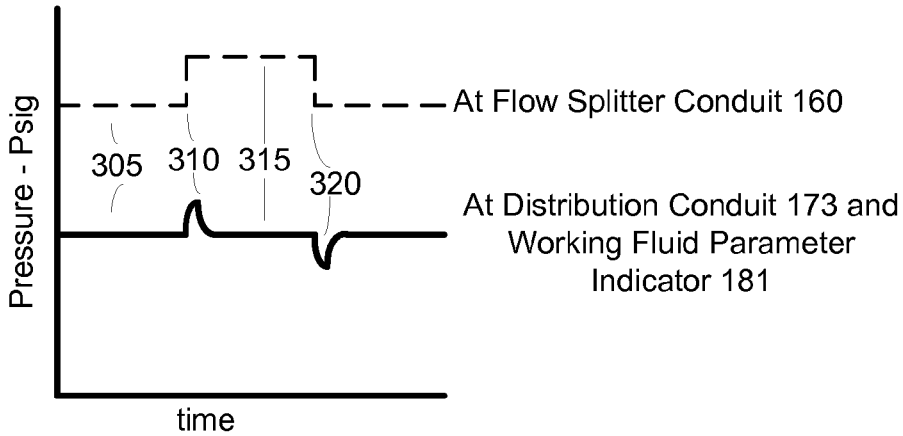

The increase and decrease in the pressure that occur during the operational test as described above are illustrated in FIG. 3B. In particular, FIG. 3B shows the pressure at flow splitter conduit 160, distribution conduit 173 and working fluid parameter indicator 181. As shown in FIG. 3B, the pressure increases at flow splitter conduit 160, distribution conduit 173 and working fluid parameter indicator 181 as lag centrifugal machine 110 is turned on (region 310). The pressure stabilizes at flow splitter conduit 160, distribution conduit 173 and working fluid parameter indicator 181 as flow regulator 179 regulates the flow of the hydraulic fluid (region 315). FIG. 3B further shows that the pressure decreases at flow splitter conduit 160, distribution conduit 173 and working fluid parameter indicator 181 as lag centrifugal machine 110 is turned off (region 320).

Figure 3C:
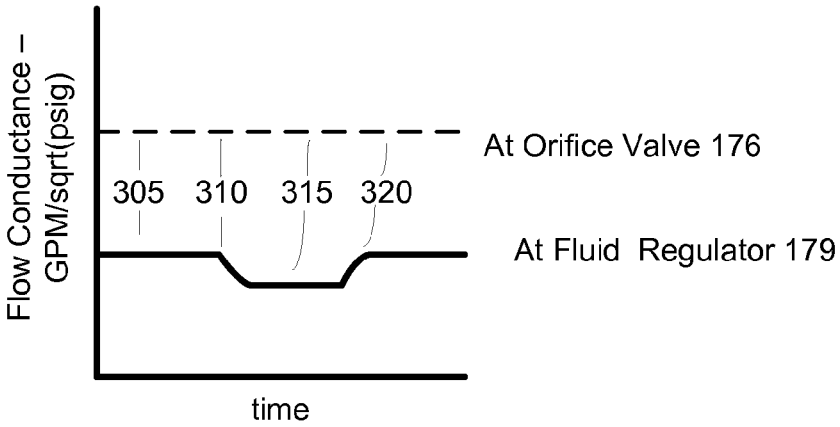

The effects that the increase and decrease in the flow and pressure have on fluid regulator 179 and orifice valve 177 during the operational test are illustrated in FIG. 3C. As shown in FIG. 3C, the flow of the hydraulic fluid through orifice valve 177 in this embodiment is stable during the operational test and is not affected by the turning on and off of lag centrifugal machine 110 (regions 310 and 320). On the other hand, the flow of the hydraulic fluid through fluid regulator 179 is affected by the turning on and off of lag centrifugal machine 110 (regions 310 and 320). As noted above, at region 310, the disturbance caused by turning on lag centrifugal machine 310 causes fluid regulator 179 to decrease the flow of hydraulic fluid through valve 175 to decrease the pressure. Fluid regulator 179 decreases the flow of the hydraulic fluid causing it to stabilize to equilibrium at region 315. At region 320, lag centrifugal machine 310 is turned off which causes fluid regulator 179 to increase the flow of hydraulic fluid through valve 175 to increase the pressure. Fluid regulator 179 increases the flow of the hydraulic fluid causing it to stabilize back to equilibrium once lead centrifugal machine retains the load of supplying the hydraulic fluid to tank 185.

The data embodied by these graphs provides a baseline as either raw data or a signature of data that controller 190 can use to compare to measurements taken from working fluid parameter indicator 181 during the operational test to determine sensitivity of the instrument. For example, if measurements taken from working fluid parameter indicator 181 or some other process instrument (e.g., flow meter) in process operation 100 are not within an acceptable range of deviation of the data and waveforms embodied in FIGS. 3A-3C, then this is an indication that sensitivity of the process instrument is not operating properly. Controller 190 can then generate a notification to a plant operator of the instrument malfunction. Note that those skilled in the art will recognize it is desirable to have the starting time of the motor of lag centrifugal machine 110 faster than the ability of fluid regulator 179 to respond to the rising pressure in order to take advantage of the diagnostic tool described herein. If not, then there is the potential that the regulator will mask the pressure rise effect from the parallel motor starting of the lag centrifugal machine, preventing the ability to use this information as a diagnostic.

Those skilled in the art will recognize that similar graphs can be generated for centrifugal fans and centrifugal compressors in order to ascertain diagnostic features that can be used as a baseline for comparing to measurements acquired during a similar operational test described herein, but for applications such as for example ventilation systems.

Figure 4:
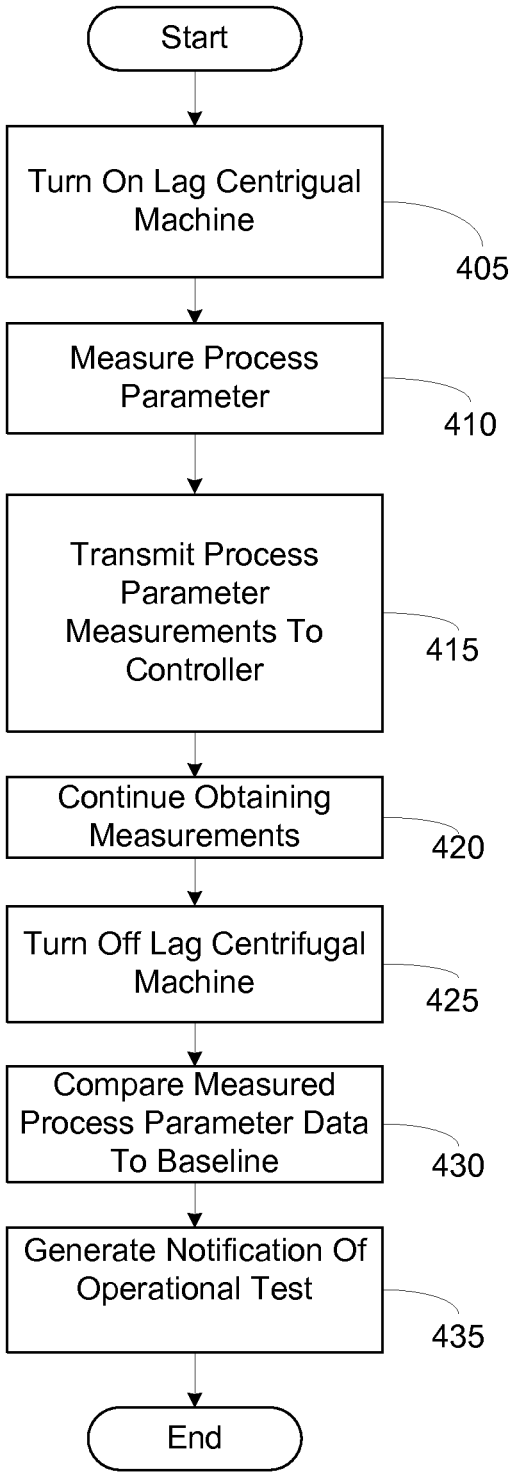
FIG. 4 is a flow chart describing operations associated with performing the operational test on the centrifugal machines depicted in FIG. 1 according to one embodiment of the present invention.

FIG. 4 is a flow chart 400 describing operations associated with performing the operational test on the redundant centrifugal machines (lead centrifugal machine 105 and lag centrifugal machine 110) in order to validate the sensitivity of a process instrument (e.g., working fluid parameter indicator 181, fluid regulator 179, flow meters, etc.) within process operation 100. In FIG. 4, flow chart 400 begins by turning on lag centrifugal machine 110 while lead centrifugal machine 105 is currently operating at 405. Working fluid parameter indicator 181 captures measurements of process parameters at 410. In this embodiment, working fluid parameter indicator is capturing pressure data of the hydraulic fluid. If a flow meter was being used, then the flow data would be the process parameter being measured. The measured process parameter data is transmitted to controller 190 at 415 by any one of a number of currently available electronic communications systems such as Modbus, Prophibus, CanBus, Foundation Field Bus, High Speed Ethernet, etc.

The obtaining and transmitting of measurements of the process parameters continue at 420 for a predetermined period of time after the supply of the hydraulic fluid by lead centrifugal machine 105 and lag centrifugal machine have stabilized to an equilibrium level. For example, the obtaining and transmitting of measurements of the process parameters can be three to four times the control time constants, which may be seconds for liquid working fluids to minutes for gases. Next in the flow chart, lag centrifugal machine 110 is turned off at 425. At 430, a comparison of the measured process parameter data is compared to a baseline of previously obtained values to determine whether the sensitivity of the process instrument (e.g., fluid regulator, pressure sensor, flow meter) is within an acceptable range. Controller 190 can then generate a status notification at 435 to the plant operator if process instrument is not operating properly. As mentioned above, the status notification can include an alarm, an electronic mail, or a report that provides the measurements, deviation from the baseline data, various details of the events that have occurred during the process operation and possible causes for notifications containing poor operability results and a list of potential corrective actions. In addition to generating a status notification, controller 190 can store the results of the diagnostic operational test for future reference and analysis.

The foregoing flow chart of FIG. 4 shows some of the processing functions associated with using controller 190 to validate the sensitivity of a process instrument from a diagnostic operational test. In this regard, each block represents a process act associated with performing these functions. It should also be noted that in some alternative implementations, the acts noted in the blocks may occur out of the order noted in the figure or, for example, may in fact be executed substantially concurrently or in the reverse order, depending upon the act involved. Also, one of ordinary skill in the art will recognize that additional blocks that describe the processing functions may be added.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A system, comprising:

a distribution conduit;

at least two centrifugal machines configured to supply a working fluid to the distribution conduit, wherein one of the at least two centrifugal machines comprises a lead centrifugal machine and a second of the at least two centrifugal machines comprises a lag centrifugal machine;

a working fluid parameter indicator that measures a process parameter associated with the working fluid supplied to the distribution conduit by the at least two centrifugal machines; and a controller that validates the sensitivity of the working fluid parameter indicator to measure the process parameter associated with the working fluid, the controller validating the sensitivity of the working fluid parameter indicator as a function of operation of the lag centrifugal machine relative to the lead centrifugal machine during an operational test of the centrifugal machines.

2. The system according to claim 1, wherein the operational test includes turning on the lag centrifugal machine while the lead centrifugal machine is on to contribute in sharing a load of supplying the working fluid to the distribution conduit, and turning off the lag centrifugal machine after operating in conjunction with the lead centrifugal machine for a predetermined period of time to transfer the load back to the lead centrifugal machine.

3. The system according to claim 2, wherein the controller receives a plurality of process parameter measurements from the working fluid parameter indicator during the operational test.

4. The system according to claim 3, wherein the controller compares the plurality of process parameter measurements to a baseline of previously obtained process parameter measurements.

5. The system according to claim 4, wherein the controller validates the sensitivity of the working fluid parameter indicator in response to determining that the plurality of process parameter measurements obtained during the operational test are within an acceptable range of deviation to the baseline of previously obtained process parameter measurements.

6. The system according to claim 3, wherein the controller forms an operational test signature from the plurality of process parameter measurements, wherein the operational test signature is characterized by a peak portion indicative of when the lag centrifugal machine turned on, a trough portion indicative of when the lag centrifugal machine turned off, a middle portion between the peak portion and the trough portion that is indicative of a stable state in which the lead centrifugal machine and the lag centrifugal machine share the load.

7. The system according to claim 6, wherein the controller compares the operational test signature to a baseline operational test signature having a baseline peak portion indicative of a turn-on event for the lag centrifugal machine, a baseline trough portion indicative of a turn-off event for the lag centrifugal machine, a baseline middle portion between the baseline peak portion and the baseline trough portion that is indicative of a stable operational running event in which the lead centrifugal machine and the lag centrifugal machine share the load.

8. The system according to claim 7, wherein the controller validates the sensitivity of the working fluid parameter indicator in response to determining that the peak portion, middle portion and trough portion of the operational test signature are within an acceptable range of deviation to the baseline peak portion, the baseline middle portion and the baseline trough portion of the baseline operational test signature, respectively.

9. The system according to claim 1, wherein the lead centrifugal machine and the lag centrifugal machine operate in parallel sharing the supply of the working fluid to the distribution conduit.

10. The system according to claim 1, further comprising a working fluid regulator that regulates the flow of the working fluid according to the process parameter measured by the working fluid parameter indicator.

11. A system, comprising:

a distribution conduit;

at least two redundant centrifugal machines configured to supply a working fluid to the distribution conduit, wherein one of the at least two redundant centrifugal machines comprises a lead centrifugal machine and a second of the at least two redundant centrifugal machines comprises a lag centrifugal machine;

a flow splitter conduit that splits the flow of the working fluid from the at least two redundant centrifugal machines to the distribution conduit into different flow paths;

one or more working fluid parameter indicators that measures a process parameter associated with the working fluid as supplied from the flow splitter conduit to the distribution conduit;

a working fluid regulator located between the flow splitter conduit and the distribution conduit that regulates the flow of the working fluid therebetween according to the process parameter measured by the one or more working fluid parameter indicators; and a controller that validates the operational health of at least one of the working fluid parameter indicators and the working fluid regulator based on an operational test performed on the lead centrifugal machine and the lag centrifugal machine.

12. The system according to claim 11, wherein the operational test includes turning on the lag centrifugal machine while the lead centrifugal machine is on to contribute in sharing a load of supplying the working fluid to the distribution conduit, and turning off the lag centrifugal machine after operating in conjunction with the lead centrifugal machine for a predetermined period of time to transfer the load back to the lead centrifugal machine.

13. The system according to claim 12, wherein the controller receives a plurality of process parameter measurements from each of the working fluid parameter indicators during the operational test.

14. The system according to claim 13, wherein the controller compares the plurality of process parameter measurements to a baseline of previously obtained process parameter measurements.

15. The system according to claim 14, wherein the controller validates the operational health of at least one of the working fluid parameter indicators and the working fluid regulator in response to determining that the plurality of process parameter measurements obtained during the operational test are within an acceptable range of deviation to the baseline of previously obtained process parameter measurements.

16. The system according to claim 13, wherein the controller forms an operational test signature from the plurality of process parameter measurements, wherein the operational test signature is characterized by a peak portion indicative of when the lag centrifugal machine turned on, a trough portion indicative of when the lag centrifugal machine turned off, a middle portion between the peak portion and the trough portion that is indicative of a stable state in which the lead centrifugal machine and the lag centrifugal machine share the load.

17. The system according to claim 16, wherein the controller compares the operational test signature to a baseline operational test signature having a baseline peak portion indicative of a turn-on event for the lag centrifugal machine, a baseline trough portion indicative of a turn-off event for the lag centrifugal machine, a baseline middle portion between the baseline peak portion and the baseline trough portion that is indicative of a stable operational running event in which the lead centrifugal machine and the lag centrifugal machine share the load.

18. The system according to claim 17, wherein the controller validates the operational health of at least one of the working fluid parameter indicators and the working fluid regulator in response to determining that the peak portion, middle portion and trough portion of the operational test signature are within an acceptable range of deviation to the baseline peak portion, the baseline middle portion and the baseline trough portion of the baseline operational test signature, respectively.

19. The system according to claim 11, wherein the lead centrifugal machine and the lag centrifugal machine operate in parallel sharing the supply of the working fluid to the distribution conduit.

20. The system according to claim 11, further comprising an orifice valve located between the flow splitter conduit and the distribution conduit, wherein the orifice valve is located along a first flow path between the flow splitter conduit and the distribution conduit and the working fluid regulator is located along a second flow path between the flow splitter conduit and the distribution conduit.

* * * * *